US010453366B2

(12) United States Patent
Zhang et al.

(10) Patent No.: US 10,453,366 B2
(45) Date of Patent: Oct. 22, 2019

(54) SYSTEM AND METHOD FOR WHITE SPOT MURA DETECTION

(71) Applicant: Samsung Display Co., Ltd., Yongin-si, Gyeonggi-do (KR)

(72) Inventors: Yiwei Zhang, Campbell, CA (US); Janghwan Lee, Pleasanton, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 203 days.

(21) Appl. No.: 15/639,859

(22) Filed: Jun. 30, 2017

(65) Prior Publication Data

US 2018/0301071 A1 Oct. 18, 2018

Related U.S. Application Data

(60) Provisional application No. 62/486,928, filed on Apr. 18, 2017.

(51) Int. Cl.
*G09G 3/00* (2006.01)

(52) U.S. Cl.
CPC ..... *G09G 3/006* (2013.01); *G09G 2330/08* (2013.01); *G09G 2330/10* (2013.01); *G09G 2354/00* (2013.01); *G09G 2360/14* (2013.01); *G09G 2360/145* (2013.01)

(58) Field of Classification Search
CPC ..... G09G 2330/08; G09G 2330/10; G09G 2354/00; G09G 2360/14; G09G 2360/145; G09G 3/006
See application file for complete search history.

(56) References Cited

U.S. PATENT DOCUMENTS

| | | | | |
|---|---|---|---|---|
| 7,689,029 | B2 | 3/2010 | Onishi et al. | |
| 8,457,414 | B2 | 6/2013 | Jahanbin et al. | |
| 2003/0228049 | A1 | 12/2003 | Asai | |
| 2005/0100221 | A1* | 5/2005 | Li | G06T 7/33 382/206 |
| 2013/0155061 | A1* | 6/2013 | Jahanshahi | G06T 15/00 345/419 |

(Continued)

FOREIGN PATENT DOCUMENTS

| | | | |
|---|---|---|---|
| CN | 105913419 | A | 8/2016 |
| KR | 10-2006-0007889 | A | 1/2006 |

(Continued)

*Primary Examiner* — Dmitriy Bolotin
(74) *Attorney, Agent, or Firm* — Lewis Roca Rothgerber Christie LLP

(57) ABSTRACT

A method for detecting one or more white spot MURA defects in a display panel includes receiving an image of the display panel, the image including the one or more white spot MURA defects, dividing the image into a plurality of patches, each one of the plurality of patches corresponding to an m pixel by n pixel area of the image (wherein m and n are integers greater than or equal to one), generating a plurality of feature vectors for the plurality of patches, each of the feature vectors corresponding to one of the plurality of patches and including one or more image texture features and one or more image moment features, and classifying each one of the plurality of patches based on a respective one of the plurality of feature vectors by utilizing a multi-class support vector machine to detect the one or more white spot MURA defects.

20 Claims, 4 Drawing Sheets

(56) References Cited

U.S. PATENT DOCUMENTS

| | | | | |
|---|---|---|---|---|
| 2013/0278750 | A1* | 10/2013 | Holec | H04N 7/18 348/87 |
| 2014/0185888 | A1* | 7/2014 | Kelm | G06T 7/0014 382/128 |

FOREIGN PATENT DOCUMENTS

| | | | |
|---|---|---|---|
| KR | 10-2014-0067394 | A | 6/2014 |
| KR | 10-1477665 | B1 | 12/2014 |
| KR | 10-2016-0031142 | A | 3/2016 |

* cited by examiner

SYSTEM AND METHOD FOR WHITE SPOT MURA DETECTION

CROSS-REFERENCE TO RELATED APPLICATION(S)

This application claims priority to, and the benefit of, U.S. Provisional Application No. 62/486,928 ("System and Method for White Spot Mura Detection"), filed on Apr. 18, 2017, the entire content of which is incorporated herein by reference.

FIELD

Aspects of embodiments of the present invention are related to a system for defect detection and a method for using the same.

BACKGROUND

In recent years, the display industry has been growing rapidly as new display technologies have been introduced to the market. Mobile devices, televisions, virtual reality (VR) headsets and other displays have been a constant force in driving displays to have higher resolutions and more accurate color reproductions. As new types of display panel modules and production methods are being deployed, surface defects have become harder to inspect using the conventional methods.

The above information disclosed in this Background section is only for enhancement of understanding of the invention, and therefore it may contain information that does not form the prior art that is already known to a person of ordinary skill in the art.

SUMMARY

Aspects of embodiments of the present invention are directed to an automated inspection system and method, which utilizes machine learning to improve the speed and accuracy of defect detection, such as the detection of white spot Mura defects. In some embodiments, the automated inspection system receives an image taken of a display device, partitions the image into patches, calculates the image features of each patch, and uses the calculated features to identify the patches which contain a defect, such as a white spot Mura by utilizing a trained support vector machine (SVM). In some embodiments, the features include a combination of texture features and image moments.

According to some embodiments of the present invention, there is provided a method for detecting one or more white spot MURA defects in a display panel, the method including: receiving an image of the display panel, the image including the one or more white spot MURA defects; dividing the image into a plurality of patches, each one of the plurality of patches corresponding to an m pixel by n pixel area of the image (wherein m and n are integers greater than or equal to one); generating a plurality of feature vectors for the plurality of patches, each of the feature vectors corresponding to one of the plurality of patches and including one or more image texture features and one or more image moment features; and classifying each one of the plurality of patches based on a respective one of the plurality of feature vectors by utilizing a multi-class support vector machine (SVM) to detect the one or more white spot MURA defects.

In some embodiments, the plurality of patches do not overlap each other.

In some embodiments, each patch is greater in size than an average white spot Mura defect.

In some embodiments, each patch corresponds to a 32 pixel by 32 pixel area of the display panel.

In some embodiments, the one or more image texture features include at least one of a contrast grey-level co-occurrence matrix (GLCM) texture feature and a dissimilarity GLCM texture feature.

In some embodiments, the one or more image moment features include at least one of a third order centroid moment μ30, a fifth Hu invariant moment I5, and a first Hu invariant moment I1.

In some embodiments, the multi-class SVM is trained using both defect-containing and defect-free images.

In some embodiments, the classifying of the one or more white spots includes: providing the plurality of feature vectors for the plurality of patches to the multi-class SVM to identify the one or more white spots based on the feature vectors; and labeling one or more patches of the plurality of patches including the identified one or more white spots as defective.

According to some embodiments of the present invention, there is provided a method for training a system for detecting one or more white spot defects in a display panel, the method including: receiving an image of the display panel, the image including the one or more white spot defects; decomposing the image into a first plurality of patches and a second plurality of patches, each of the first and second plurality of patches corresponding to the image of the display panel; receiving a plurality of labels, each label of the plurality of labels corresponding to one of the first and second plurality of patches and indicating defective or not defective; generating a plurality of feature vectors, each one of the plurality of feature vectors corresponding to a patch of one of the first and second plurality of patches and including one or more image texture features and one or more image moment features; and training a multi-class support vector machine (SVM) to detect the one or more white spots by providing the SVM with the plurality of feature vectors and the plurality of labels.

In some embodiments, the second plurality of patches is offset from and overlapping the first plurality of patches.

In some embodiments, each one of the plurality of patches corresponds to an m pixel by n pixel area of the image (wherein m and n are integers greater than or equal to one).

In some embodiments, decomposing the image includes further decomposing the image into a third plurality of patches and a fourth plurality of patches, each of the third and fourth plurality of patches corresponding to the image of the display panel, wherein the plurality of labels further include additional labels corresponding to the third and fourth plurality of patches and indicating defective or not defective, wherein each one of the plurality of feature vectors corresponds to a patch of one of the first, second, third, and fourth plurality of patches, and includes one or more image texture features and one or more image moment features, wherein each one of the plurality of patches corresponds to a 32 pixel by 32 pixel area of the image, and wherein ones of the first to fourth plurality of patches are offset from each other by 16 pixels in at least one of a lengthwise direction and a widthwise direction of the image.

In some embodiments, the one or more image texture features include at least one of a contrast grey-level co-occurrence matrix (GLCM) texture feature and a dissimilarity GLCM texture feature.

In some embodiments, the one or more image moment features include at least one of a third order centroid moment μ30, a fifth Hu invariant moment I5, and a first Hu invariant moment I1.

According to some embodiments of the present invention, there is provided a system for detecting one or more white spot defects in a display panel, the system including: a processor; and a processor memory local to the processor, wherein the processor memory has stored thereon instructions that, when executed by the processor, cause the processor to perform: receiving an image of the display panel, the image including the one or more white spot defects; dividing the image into a plurality of patches, each one of the plurality of patches corresponding to an m pixel by n pixel area of the image (wherein m and n are integers greater than or equal to one); generating a plurality of feature vectors for the plurality of patches, each of the feature vectors corresponding to one of the plurality of patches and including one or more image texture features and one or more image moment features; and classifying each one of the plurality of patches based on a respective one of the plurality of feature vectors by utilizing a multi-class support vector machine (SVM) to detect the one or more white spots.

In some embodiments, the plurality of patches do not overlap each other, and each patch is greater in size than an average white spot Mura defect.

In some embodiments, the one or more image texture features include at least one of a contrast grey-level co-occurrence matrix (GLCM) texture feature and a dissimilarity GLCM texture feature.

In some embodiments, the one or more image moment features include at least one of a third order centroid moment μ30, a fifth Hu invariant moment I5, and a first Hu invariant moment I1.

In some embodiments, the multi-class SVM is trained using both defect-containing and defect-free images.

In some embodiments, the each one of the plurality of patches includes: providing the plurality of feature vectors for the plurality of patches to the multi-class SVM to identify the one or more white spots based on the feature vectors; and labeling one or more patches of the plurality of patches including the identified one or more white spots as defective.

BRIEF DESCRIPTION OF THE DRAWINGS

The accompanying drawings, together with the specification, illustrate example embodiments of the present invention, and, together with the description, serve to explain the principles of the present invention.

DETAILED DESCRIPTION

The detailed description set forth below is intended as a description of example embodiments of a system and method for defect detection, provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
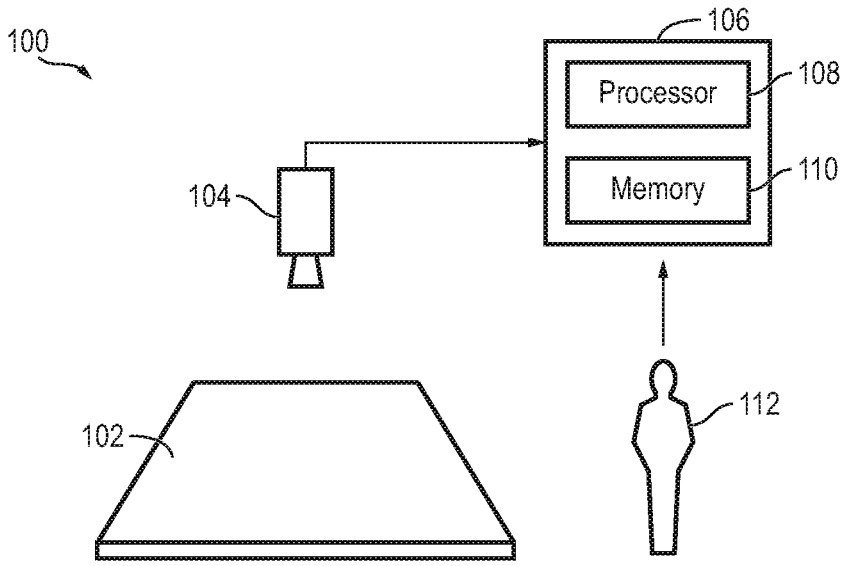
FIG. 1 is a block diagram of an image acquisition and defect detection system, according to some example embodiments of the present invention.

FIG. 1 is a block diagram of an image acquisition and defect detection system 100, according to some example embodiments of the present invention.

Referring to FIG. 1, the image acquisition and defect detection system 100 (also referred to herein as the defect detection system) is configured to detect defects in a display panel 102 using an image of the display panel 102. In some embodiments, the defect detection system 100 is configured to detect the presence of, and locate, white spot Mura defects (e.g., brightness non-uniformities) in a display panel undergoing testing. In some examples, only white spot Mura defects may be detected while ignoring all other types of defects that may be present in the display panel 102, such as, black spots, white streaks, horizontal line muras, glass defects, dust, smudges, and the like.

According to some embodiments, the defect detection system 100 includes a camera 104 and a defect detector 106. The camera 104 may capture an image (e.g., a RAW, uncompressed image) of a top surface (e.g., a display side) of the display panel 102, which in some examples, may be traveling along a conveyor belt in a test or manufacturing facility. In some examples, the image may be an uncompressed image (e.g., having a RAW format) of an entire top surface of the display panel 102 and may capture all or substantially all of the pixels in the display panel 102. The camera 104 then transmits the image to the defect detector 106, which analyzes the image to detect the presence of any defects (e.g., white spot Mura defects).

In some embodiments, the defect detector 106, which includes a processor 108 and a memory 110 coupled to the processor 108, divides the captured image into patches for inspection. Each patch is then analyzed for instances of defects, such as white spot Mura defects, by a trained machine learning component. In some embodiments, the machine learning component includes a support vector machine (SVM), for example, a multi-class SVM, which is a supervised learning model (and non a predetermined mathematical formula) that is configured to classify an input as one of two categories, either as having a defect (e.g., a white spot Mura defect) or being defect free. The defect detector 106 then generates a combination of features for each of the image patches and provides them to the SVM for classification. For example, the features may include a combination of texture features and image moments. The SVM categorizes each image patch as having or not having a defect (e.g., having an instance of white spot Mura) and labels image patches where the defects (e.g., the instances of white spot Mura) are present.

In some examples, the SVM may be trained by a human operator 112, as described in further detail below.

Figure 2:
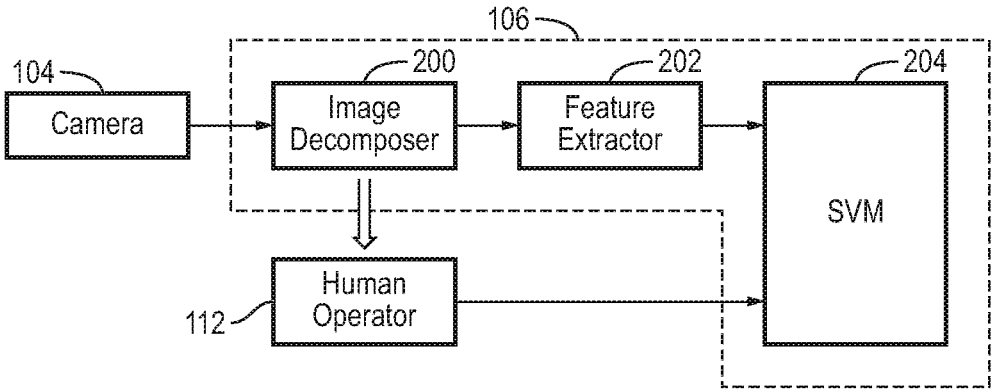
FIG. 2 is a block diagram illustrating a defect detector, according to some exemplary embodiments of the present invention.

FIG. 2 is a block diagram illustrating the defect detector 106 in further detail, according to some exemplary embodiments of the present invention.

Referring to FIG. 2, the defect detector 106 includes an image decomposer 200, a feature extractor 202, and an SVM (e.g., a multi-class SVM) 204. The defect detector is configured to operate in a training mode, and in a detection mode.

According to some embodiments, when operating in training mode, the image decomposer 200 is configured to decompose (e.g., divide or partition) the image of the display panel it receives from the camera 104 into several sets of patches, with each set of patches covering all or nearly all of the display panel pixels. That is, the patches of each set of patches overlap with corresponding patches of all other sets of patches.

The feature extractor 202 operates on the individual patches generated by the image decomposer 200 to extract the image features of each patch. In some embodiments, the features include one or more image texture features and one or more image moment features. In some examples, the image texture features include at least one of a contrast grey-level co-occurrence matrix (GLCM) texture feature and a dissimilarity GLCM texture feature, and the image moment features include at least one of a third order centroid moment $\mu_{30}$, a fifth Hu invariant moment $I_5$, and a first Hu invariant moment $I_1$.

As understood by a person of ordinary skill in the art, the GLCM features aid in characterizing the texture of an image by calculating how often pairs of pixels with specific brightness values (e.g., grey levels) and in a specified spatial relationship occur in an image. Further, it is understood that the third order centroid moment $\mu_m$ is translational invariant, and the fifth Hu invariant moment $I_5$ and the first Hu invariant moment $I_1$ are invariants with respect to translation, scale, and rotation transformations. The formulaic definitions of said image moment features may be found in Appendix A, filed concurrently herewith, the entire content of which is incorporated herein by reference.

The feature extractor 202 constructs, for each individual patch, a feature vector including the one or more image texture features and the one or more image moment features. In some examples, the constructed feature vector includes a third order centroid moment $\mu_{30}$, a contrast GLCM texture feature, a dissimilarity GLCM texture feature, a fifth Hu invariant moment $I_5$, and a first Hu invariant moment $I_1$. However, embodiments of the present invention are not limited thereto. For example, the constructed feature vector may exclude one or both of the fifth Hu invariant moment $I_5$, and a first Hu invariant moment $I_1$ and/or the dissimilarity GLCM texture feature. When in training phase, the feature extractor 202 forwards the constructed vectors to the SVM 204 as a first training dataset.

The sets of patches generated by the image decomposer 200 are also sent to a human operator who manually inspects the individual patches for the presence of a defect (e.g., a white spot Mura defect) and manually labels each patch as either defective or non-defective (or defect free). The results are provided to the SVM 204 as a second training dataset. According to some embodiments, the human operator may identify only white spot Mura defects at the exclusion of all other types of defects, such as black spots, white streaks, etc. As such, in some embodiments, the multi-class SVM 204 may be trained to only detect white spot Mura defects and ignore all other types of defects.

The SVM (e.g., the multi-class SVM) 204 then uses the feature vectors of each patch, which include both defective and non-defective patches, as well as the corresponding labels of defective or non-defective to train the defect detector 106 for the detection of any defects (e.g., any white spot Mura defects). In some examples, the SVM 204 trains using not only patches from a single image but from several different images from different display panels.

Once training is complete, the defect detector 106 may be operated in detection mode, during which the SVM 204 replaces the human operator 112 in labeling patches of an image of the display panel 102. According to some embodiments, when in training mode, the image decomposer 200 decomposes (e.g., divides or partitions) an image captured of the display panel 102 into a set of (e.g., only a single set of) non-overlapping patches that cover all or nearly all of the pixels of the display panel 102. The feature extractor 202 then operates on the set of non-overlapping patches to extract the image features of each patch and to generate a feature vector for each patch, as described above with reference to the training mode. The SVM 204 then utilizes the generated feature vectors to classify each patch as either defective or non-defective.

In some embodiments, the size of each patch is chosen such that it is greater than the size of a typical defect (e.g., the average size of a white spot Mura defect), but also small enough to provide a good measure of granularity in determine the location of the defect on the display panel.

Thus, in some embodiments, by visually inspecting the display panel 102 and extracting the right set of image features (e.g., third order centroid moment $\mu_{30}$, contrast and dissimilarity GLCM texture features, and first and fifth Hu invariant moments $I_1$ and $I_5$), the defect detector 106, is capable of detecting and locating the presence of a particular type of defect, such as white spot Mura defects. This provides great precision in detecting and localizing the desired defect and allows for the compensation of the defect in certain instances.

In some examples, the display panels identified by the defect detector 106 as containing defects may be rejected and removed from the product line. However, in some embodiments, the location of the defects (e.g., the white spot Mura defects), as identified by the position (e.g., coordinates) of patches labeled as defective may be utilized to electronically compensate for the defect, and thus, eliminating or substantially eliminating the defects from the display panel. Thus, by facilitating the compensation of defects in the display panel, the defect detector 106 aids in improving manufacturing/production yield of the display panels. For example, in some embodiments, the defect detector 106 and electronic compensation may form a loop that iterates through various compensation parameters until the defect is no longer visible. Accordingly, a compensation parameter is applied to the panel for each identified instance of white spot mura, a new image of the panel is taken, and the image is again provided to the defect detector 106.

As understood by a person of ordinary skill in the art, the image decomposer 200, the feature extractor 202, the multi-class SVM 204, and any other logical components of the defect detection system 106 may be represented with the processor 108 and the memory 110, which has instructions stored thereon that when executed by the processor 108, cause the processor 108 to perform the functions attributed to the defect detection system 106 (e.g., the image decomposer 200, the feature extractor 202, the multi-class SVM 204).

Figure 3A:
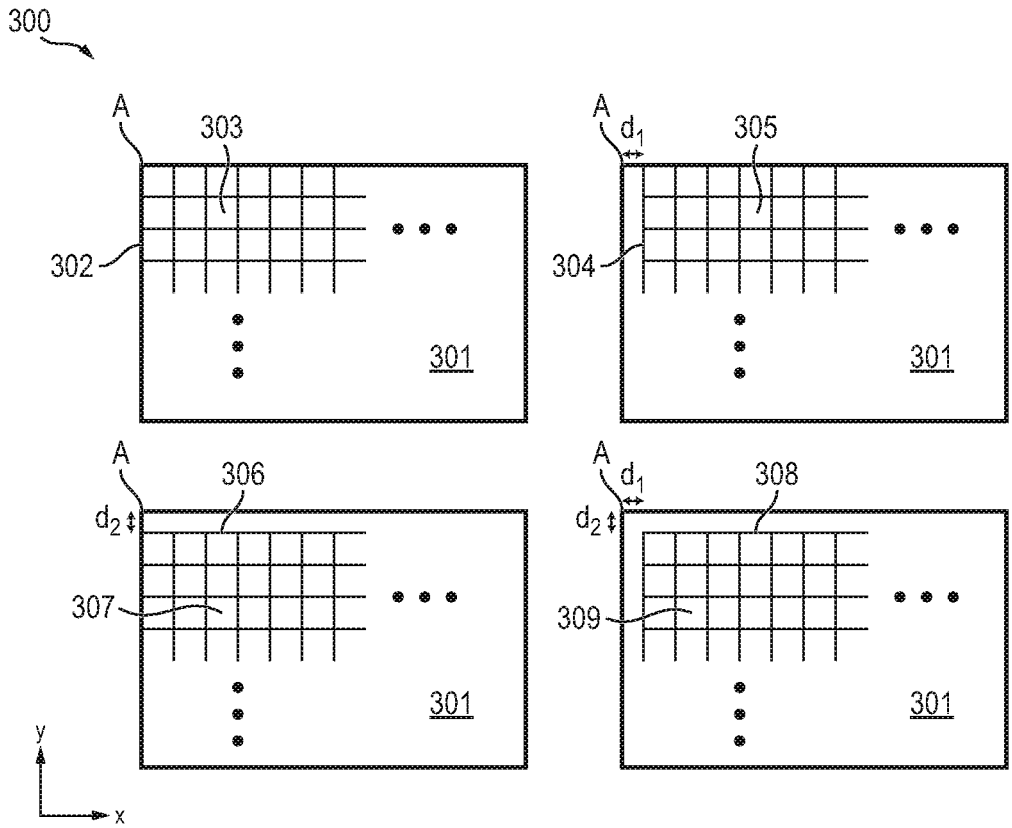
FIG. 3A illustrates several sets of patches generated by an image decomposer in training mode, according to some exemplary embodiments of the present invention.
Figure 3B:
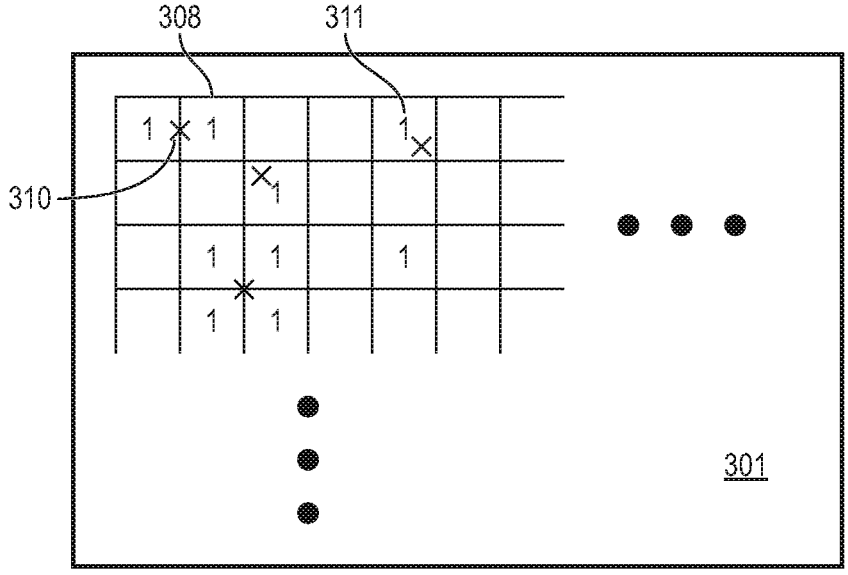
FIG. 3B illustrates labeled defect-containing patches in a decomposed image of a display panel, according to some embodiments of the present invention.

FIG. 3A illustrates several sets of patches 300 generated by the image decomposer 200 in training mode, according to some exemplary embodiments of the present invention. FIG. 3B illustrates labeled defect-containing patches in a decomposed image of a display panel, according to some embodiments of the present invention.

Referring to FIG. 3A, the image 301 represents an image captured by the camera 104 of a top surface (e.g., a display side) of the display panel 102, which may display a test image. The test image may include any suitable image for testing for the presence of defects (e.g., white spot Mura defects), such as a solid grey image. The image 301 may capture every pixel of the display panel 102; however, in some embodiments, the image 301 may only cover portions of the display panel 102. The image decomposer 200 may divide the image 301 into a first plurality of patches 302 including equal size image patches 303 starting from a corner A of the image 301. In the example of FIG. 3A, corner A represents the top left corner of the image 301, and the patches 303 are shown to have square shapes; however, embodiments of the present invention are not limited thereto, and the corner A may be any suitable corner of the image (e.g., bottom left, top right, etc., corner) and patches 303 may be rectangular in shape.

In general, the size of each image patch 303 may be expressed, in terms of the number of display pixels it contains, as m×n pixels (where m and n are positive integers). In some embodiments, the size of each image patch 303 may be set to be larger than the size of a typical defect (e.g., larger than an average size of a white spot Mura defect). For example, each patch 303 may be 32×32 pixels, in which case a first plurality of patches 302 in an image 301 of a display panel 102 with a resolution of 1920×1080 pixels may include 2040 patches (those of which overlap sides of the image opposite from the point A may be partial image patches).

According to some embodiments, when in training mode, the image decomposer 200 may further divide the image 301 into several other overlapping sets of patches. For example, the image decomposer 200 may further divide the image 301 into a second, third, and fourth plurality of patches 304, 306, and 308 respectively including image patches 305, 307, and 309, each of which may be equal in size to the image patch 303.

Each set of patches may be offset from another set of patches by a $d_1$ offset in a first direction (e.g., a lengthwise direction of the image 301 as indicated by the X-axis) and/or a $d_2$ offset in a second direction (e.g., a heightwise direction of the image 301 as indicated by the Y-axis). For example, the second plurality of patches 304 may be offset from the first plurality of patches 302 by the offset $d_1$ in the first direction (e.g., along the X-axis), the third plurality of patches 306 may be offset from the first plurality of patches 302 by the offset $d_2$ in the second direction (e.g., along the Y-axis), and the fourth plurality of patches 304 may be offset from the first plurality of patches 302 by the offsets $d_1$ and $d_2$ in the first and second directions, respectively. According to some embodiments, each set of patches may be offset from a preceding set of patches such that each of its patches overlaps a corresponding patch of the preceding set of patches by half a patch area. For example, when each patch 303/305/307/309 has a size of 32×32 pixels, the offsets $d_1$ and $d_2$ may be equal to 16 pixels.

Referring to FIG. 3B, in training mode, each of the image patches is inspected by a trained human operator who spots any defects (e.g., white spot Mura defects) 310 in the image 301 and labels the image patches that contain all or a portion of the defect. For example, the defect-containing patches ("defective patches") 311 may be labeled with a '1', while, in some examples, the remaining (e.g., non-defective) patches may be labeled with a '0'. As shown in FIG. 3B, in some examples, when a defect 310 is spotted at the border of two patches or at the corner of four patches, all patches sharing the border or corner are labeled as defective. While FIG. 3B only shows the labeled defective patches of the fourth plurality of patches 308 for ease of illustration, those of the patches 303, 305, and 307 that contain the defects 310 are similarly labeled as defective.

The manually labeled sets of patches (e.g., the labeled first to fourth plurality of patches 302, 304, 306, and 308), which include both defective and non-defective patches, along with feature vectors corresponding to each of the patches included in the sets (e.g., patches 303, 305, 307, and 309), are then provided to the SVM 204 as training data.

According to some embodiments, when in detection mode, the image decomposer 200 produces only a single set of patches (rather the multiple sets generated in training mode), which corresponds to (e.g., is the same as) the first plurality of patches 302 shown in FIG. 3A.

Figure 4A:
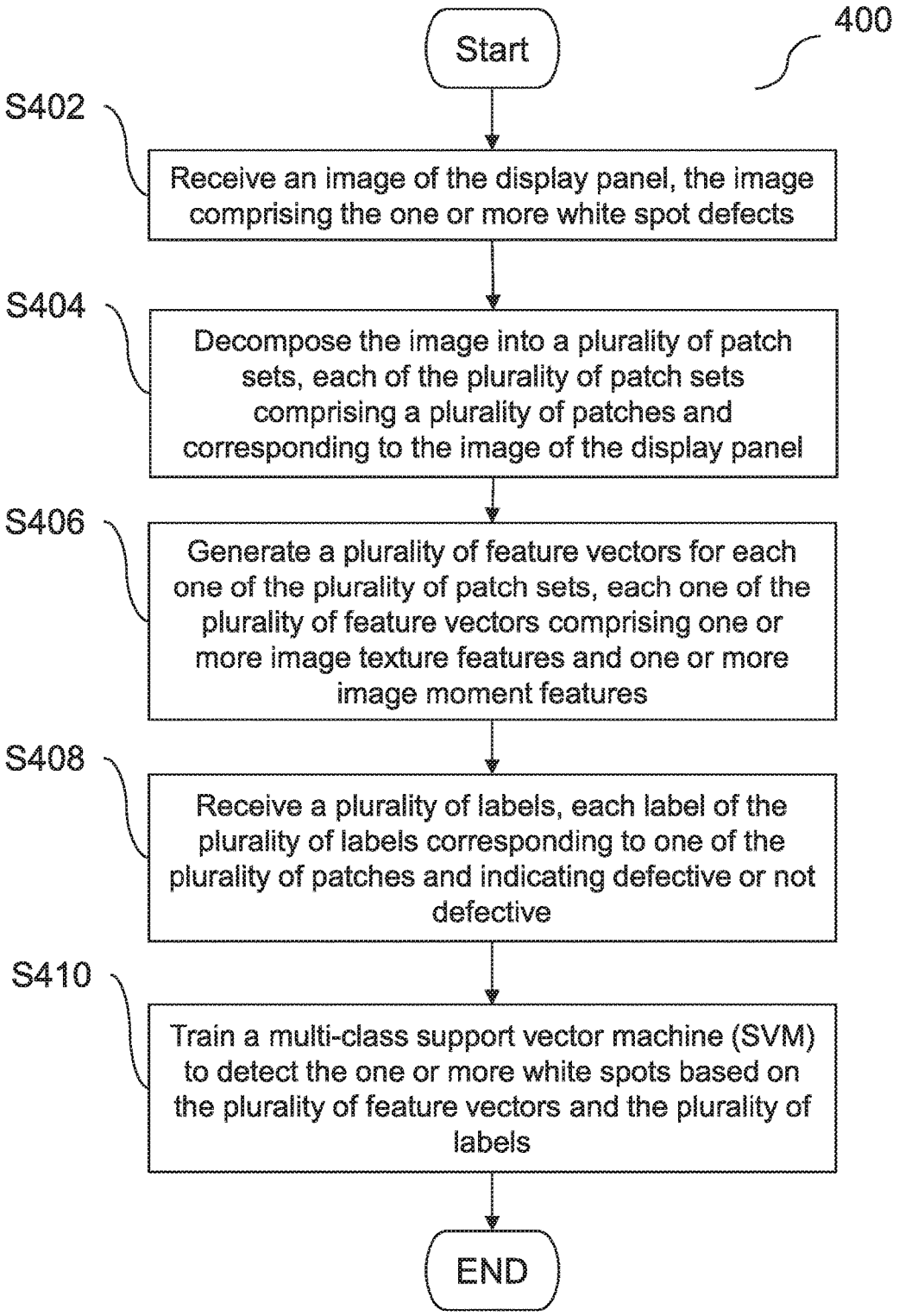
FIG. 4A is a flow diagram illustrating a process for training the defect detection system for detecting one or more defects in the display panel, according to some exemplary embodiments of the present invention.

FIG. 4A is a flow diagram illustrating a process 400 for training the defect detection system 100 for detecting one or more defects in the display panel 102, according to some exemplary embodiments of the present invention.

In act S402, the defect detection system 106 (e.g., the image decomposer 200) receives an image of the display panel 102, which may include the one or more white spot defects.

In act S404, the image decomposer 200 may decompose (e.g., divide) the image into a plurality of patch sets, for example, a first plurality of patches 302, a second plurality of patches 304, a third plurality of patches 306, and a fourth plurality of patches 308. Each of the patch sets may include a number of patches (e.g., 303, 305, 307, and 309) and may correspond to an image 301 of the display panel 102. Each one of the patches may correspond to an m pixel by n pixel area of the image 301 (wherein m and n are integers greater than or equal to one). Each one of the patch sets may be offset from and overlapping another one of the patch sets. In some examples, ones of the patch sets (e.g., ones of the first to fourth plurality of patches 302, 304, 306, and 308) are offset from each other by a set offset (e.g., 1 pixel, 2 pixels, 4 pixels, 16 pixels, etc.) in at least one of a lengthwise direction and a widthwise direction of the image.

In act S406, the defect detection system 106 (e.g., the feature extractor 202) may generate a feature vector for each patch in the plurality of patch sets. The generated plurality of feature vectors may each include one or more image texture features and one or more image moment features. The one or more image texture features may include at least one of a contrast GLCM texture feature and a dissimilarity GLCM texture feature, and the one or more image moment features may include at least one of a third order centroid moment $\mu_{30}$, a fifth Hu invariant moment $I_5$, and a first Hu invariant moment $I_1$.

In act S408, the defect detection system 106 (e.g., the multi-class support vector machine (SVM) 204) receives a plurality of labels, each of which may correspond to one of the plurality of patches and indicate the presence of a defect (e.g., a white spot Mura defect) or a lack of a defect (e.g., a lack of a white spot Mura defect). In some examples, the plurality of labels are generated by a human visually inspecting each of the patches and generating the label.

In act S410, the defect detection system 106 (e.g., the multi-class SVM 204) is trained to detect the one or more white spots based on the plurality of feature vectors and the plurality of labels. The multi-class SVM may be trained using both defect-containing and defect-free images.

Figure 4B:
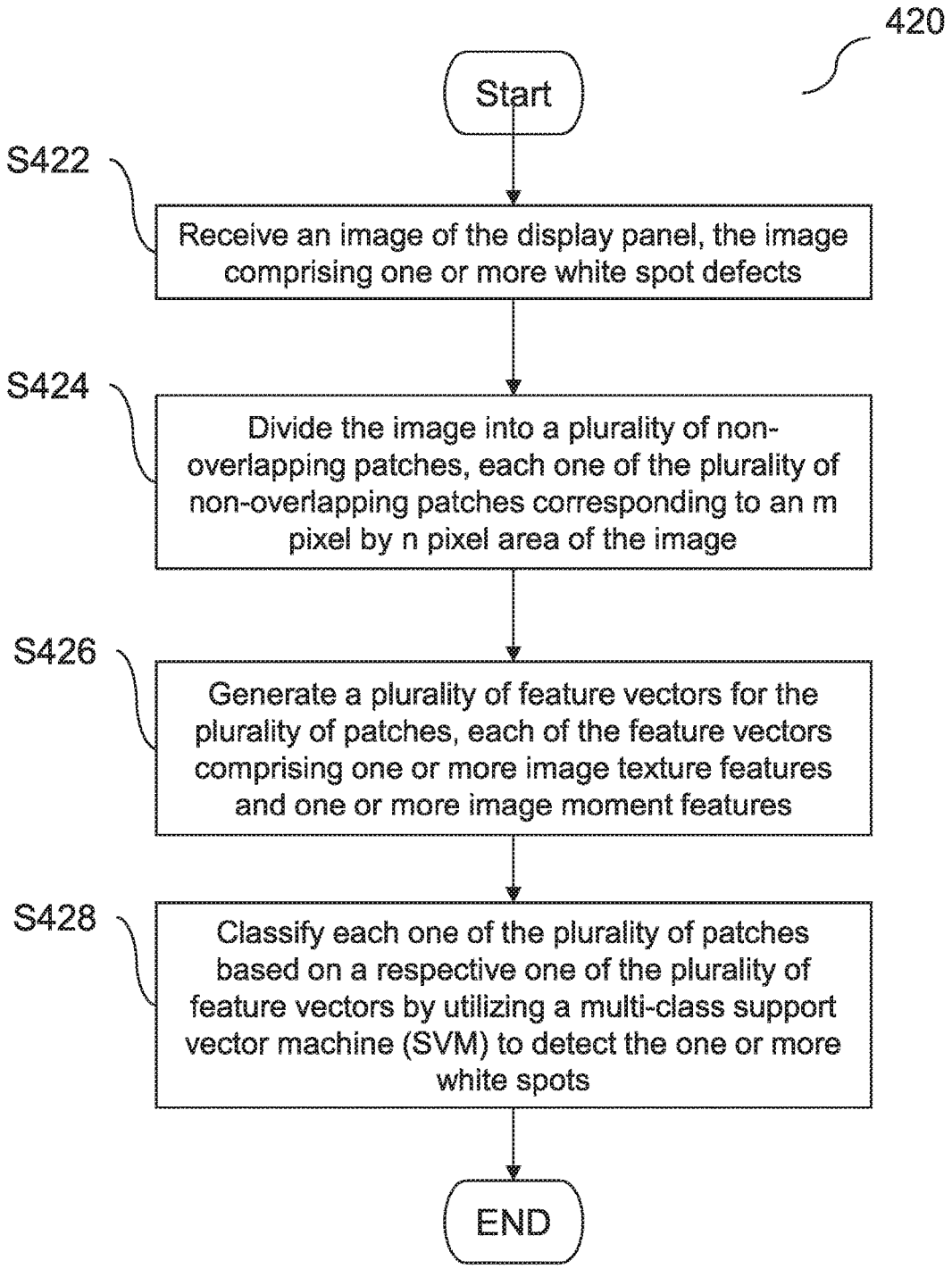
FIG. 4B is a flow diagram illustrating a process for detecting one or more white spot defects in a display panel by utilizing a defect detection system, according to some example embodiments of the present invention.

FIG. 4B is a flow diagram illustrating a process 420 for detecting one or more white spot defects in a display panel 102 by utilizing the defect detection system 106, according to some example embodiments of the present invention.

In act 422, the defect detection system 106 (e.g., the image decomposer 200) receives an image 301 of the display panel 102, which may include one or more white spot defects.

In act 424, the defect detection system 106 (e.g., the image decomposer 200) divides the image 301 into a plurality of non-overlapping patches 303, each of which corresponds to an m pixel by n pixel area of the image 301 (wherein m and n are integers greater than or equal to one) and is greater in size than an average white spot Mura defect.

In act 426, the defect detection system 106 (e.g., the feature extractor 202) generates feature vectors for each patch in the plurality of patches 303. Each of the feature vectors may include one or more image texture features and one or more image moment features. The one or more image texture features may include at least one of a contrast GLCM texture feature and a dissimilarity GLCM texture feature, and the one or more image moment features include at least one of a third order centroid moment $I_{30}$, a fifth Hu invariant moment $I_5$, and a first Hu invariant moment $I_1$.

In act 428, the defect detection system 106 utilizes the multi-class SVM to classify each one of the plurality of patches 303 using a respective one of the plurality of feature vectors. Based on the classification by the multi-class SVM, each of the plurality of patches 303 is labeled as having a defect (e.g. white spot Mura) or as being defect free (e.g. no white spot Mura). In this example, the multi-class SVM has been trained for the classification of white spot Mura. In other examples, the multi-class SVM may be trained to identify other types of display panel Mura defects. For example, the multi-class SVM 204 may be trained to identify black spot Mura, region Mura, impurity Mura, or line Mura.

Accordingly, embodiments of the present invention provide an efficient and precise defect (e.g., white spot Mura defect) detection system and method, which may use the actual raw (i.e., not simulated) image data of a display panel from a factory for not only detection, both also training purposes. Once trained under human supervision, the image acquisition and defect detection system may operate in an automatic and unsupervised fashion to detect any defects (e.g., white spot Mura defects) in display panels undergoing manufacture and testing. Thus, the automated system improves production efficiencies and reduces or eliminates the need for human visual inspections. Further, the defect detection system, according to some embodiments, identifies the location of any defects, thus allowing for the subsequent electronic compensation of the defects, which may result in higher production yields and lower overall production costs.

It will be understood that, although the terms "first", "second", "third", etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include", "including", "comprises", and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of", when preceding a list of elements, modify the entire list of elements and do not modify the individual elements of the list. Further, the use of "may" when describing embodiments of the inventive concept refers to "one or more embodiments of the inventive concept". Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the terms "substantially", "about", and similar terms are used as terms of approximation and not as terms of degree, and are intended to account for the inherent variations in measured or calculated values that would be recognized by those of ordinary skill in the art.

As used herein, the terms "use", "using", and "used" may be considered synonymous with the terms "utilize", "utilizing", and "utilized", respectively.

The defect detection system and/or any other relevant devices or components according to embodiments of the present invention described herein may be implemented by utilizing any suitable hardware, firmware (e.g., an application-specific integrated circuit), software, or a suitable combination of software, firmware, and hardware. For example, the various components of the independent multi-source display device may be formed on one integrated circuit (IC) chip or on separate IC chips. Further, the various components of the defect detection system may be implemented on a flexible printed circuit film, a tape carrier package (TCP), a printed circuit board (PCB), or formed on the same substrate. Further, the various components of the defect detection system may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer-readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

While this invention has been described in detail with particular references to illustrative embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims and equivalents thereof.

APPENDIX A

Image moment

From Wikipedia, the free encyclopedia

In image processing, computer vision and related fields, an image moment is a certain particular weighted average (moment) of the image pixels' intensities, or a function of such moments, usually chosen to have some attractive property or interpretation.

Image moments are useful to describe objects after segmentation. Simple properties of the image which are found *via* image moments include area (or total intensity), its centroid, and information about its orientation.

Contents

- 1 Raw moments
  - 1.1 Examples
- 2 Central moments
  - 2.1 Examples
- 3 Moment invariants
  - 3.1 Translation invariants
  - 3.2 Scale invariants
  - 3.3 Rotation invariants
- 4 Applications
- 5 External links
- 6 References

Raw moments

For a 2D continuous function $f(x,y)$ the moment (sometimes called "raw moment") of order $(p + q)$ is defined as $$M_{pq} = \int_{-\infty}^{\infty}\int_{-\infty}^{\infty} x^p y^q f(x,y)\,dx\,dy$$

for $p,q = 0,1,2,\ldots$ Adapting this to scalar (greyscale) image with pixel intensities $I(x,y)$, raw image moments $M_{ij}$ are calculated by $$M_{ij} = \sum_x \sum_y x^i y^j I(x,y)$$

In some cases, this may be calculated by considering the image as a probability density function, *i.e.*, by dividing the above by $$\sum_x \sum_y I(x,y)$$

A uniqueness theorem (Hu [1962]) states that if $f(x,y)$ is piecewise continuous and has nonzero values only in a finite part of the $xy$ plane, moments of all orders exist, and the moment sequence $(M_{pq})$ is uniquely determined by $f(x,y)$. Conversely, $(M_{pq})$ uniquely determines $f(x,y)$. In practice, the image is summarized with functions of a few lower order moments.

Examples

Simple image properties derived *via* raw moments include:

- Area (for binary images) or sum of grey level (for greytone images): $M_{00}$
- Centroid: $\{\bar{x}, \bar{y}\} = \{M_{10}/M_{00}, M_{01}/M_{00}\}$

Central moments

Central moments are defined as $$\mu_{pq} = \int_{-\infty}^{\infty}\int_{-\infty}^{\infty} (x-\bar{x})^p (y-\bar{y})^q f(x,y)\,dx\,dy$$

where $\bar{x} = \frac{M_{10}}{M_{00}}$ and $\bar{y} = \frac{M_{01}}{M_{00}}$ are the components of the centroid.

If $f(x, y)$ is a digital image, then the previous equation becomes $$\mu_{pq} = \sum_x \sum_y (x-\bar{x})^p (y-\bar{y})^q f(x,y)$$

The central moments of order up to 3 are:

$$\begin{aligned}
\mu_{00} &= M_{00}, \\
\mu_{01} &= 0, \\
\mu_{10} &= 0, \\
\mu_{11} &= M_{11} - \bar{x}M_{01} = M_{11} - \bar{y}M_{10}, \\
\mu_{20} &= M_{20} - \bar{x}M_{10}, \\
\mu_{02} &= M_{02} - \bar{y}M_{01}, \\
\mu_{21} &= M_{21} - 2\bar{x}M_{11} - \bar{y}M_{20} + 2\bar{x}^2 M_{01}, \\
\mu_{12} &= M_{12} - 2\bar{y}M_{11} - \bar{x}M_{02} + 2\bar{y}^2 M_{10}, \\
\mu_{30} &= M_{30} - 3\bar{x}M_{20} + 2\bar{x}^2 M_{10}, \\
\mu_{03} &= M_{03} - 3\bar{y}M_{02} + 2\bar{y}^2 M_{01}.
\end{aligned}$$

It can be shown that:

$$\mu_{pq} = \sum_m^p \sum_n^q \binom{p}{m}\binom{q}{n} (-\bar{x})^{(p-m)} (-\bar{y})^{(q-n)} M_{mn}$$

Central moments are translational invariant.

Examples

Information about image orientation can be derived by first using the second order central moments to construct a covariance matrix.

$$\begin{aligned}
\mu'_{20} &= \mu_{20}/\mu_{00} = M_{20}/M_{00} - \bar{x}^2 \\
\mu'_{02} &= \mu_{02}/\mu_{00} = M_{02}/M_{00} - \bar{y}^2 \\
\mu'_{11} &= \mu_{11}/\mu_{00} = M_{11}/M_{00} - \bar{x}\bar{y}
\end{aligned}$$

The covariance matrix of the image $I(x, y)$ is now $$\operatorname{cov}[I(x,y)] = \begin{bmatrix} \mu'_{20} & \mu'_{11} \\ \mu'_{11} & \mu'_{02} \end{bmatrix}.$$

The eigenvectors of this matrix correspond to the major and minor axes of the image intensity, so the orientation can thus be extracted from the angle of the eigenvector associated with the largest eigenvalue towards the axis closest to this eigenvector. It can be shown that this angle $\Theta$ is given by the following formula:

$$\Theta = \frac{1}{2}\arctan\left(\frac{2\mu'_{11}}{\mu'_{20} - \mu'_{02}}\right)$$

The above formula holds as long as:

$$\mu'_{20} - \mu'_{02} \neq 0$$

The eigenvalues of the covariance matrix can easily be shown to be $$\lambda_i = \frac{\mu'_{20} + \mu'_{02}}{2} \pm \frac{\sqrt{4\mu'^2_{11} + (\mu'_{20} - \mu'_{02})^2}}{2},$$

and are proportional to the squared length of the eigenvector axes. The relative difference in magnitude of the eigenvalues are thus an indication of the eccentricity of the image, or how elongated it is. The eccentricity is $$\sqrt{1 - \frac{\lambda_2}{\lambda_1}}.$$

Moment invariants

Moments are well-known for their application in image analysis, since they can be used to derive invariants with respect to specific transformation classes.

The term *invariant moments* is often abused in this context. However, while *moment invariants* are invariants that are formed from moments, the only moments that are invariants themselves are the central moments.

Note that the invariants detailed below are exactly invariant only in the continuous domain. In a discrete domain, neither scaling nor rotation are well defined: a discrete image transformed in such a way is generally an approximation, and the transformation is not reversible. These invariants therefore are only approximately invariant when describing a shape in a discrete image.

Translation invariants

The central moments $\mu_{ij}$ of any order are, by construction, invariant with respect to translations.

Scale invariants

Invariants $\eta_{ij}$ with respect to both translation and scale can be constructed from central moments by dividing through a properly scaled zero-th central moment:

$$\eta_{ij} = \frac{\mu_{ij}}{\mu_{00}^{\left(1+\frac{i+j}{2}\right)}}$$

where $i + j \geq 2$. Note that translational invariance directly follows by only using central moments.

Rotation invariants

As shown in the work of Hu et al.,[1][2] invariants with respect to translation, scale, and *rotation* can be constructed:

$$I_1 = \eta_{20} + \eta_{02}$$

$$I_2 = (\eta_{20} - \eta_{02})^2 + 4\eta_{11}^2$$

$$I_3 = (\eta_{30} - 3\eta_{12})^2 + (3\eta_{21} - \eta_{03})^2$$

$$I_4 = (\eta_{30} + \eta_{12})^2 + (\eta_{21} + \eta_{03})^2$$

$$I_5 = (\eta_{30} - 3\eta_{12})(\eta_{30} + \eta_{12})[(\eta_{30} + \eta_{12})^2 - 3(\eta_{21} + \eta_{03})^2] + (3\eta_{21} - \eta_{03})(\eta_{21} + \eta_{03})[3(\eta_{30} + \eta_{12})^2 - (\eta_{21} + \eta_{03})^2]$$

$$I_6 = (\eta_{20} - \eta_{02})[(\eta_{30} + \eta_{12})^2 - (\eta_{21} + \eta_{03})^2] + 4\eta_{11}(\eta_{30} + \eta_{12})(\eta_{21} + \eta_{03})$$

$$I_7 = (3\eta_{21} - \eta_{03})(\eta_{30} + \eta_{12})[(\eta_{30} + \eta_{12})^2 - 3(\eta_{21} + \eta_{03})^2] - (\eta_{30} - 3\eta_{12})(\eta_{21} + \eta_{03})[3(\eta_{30} + \eta_{12})^2 - (\eta_{21} + \eta_{03})^2].$$

These are well-known as *Hu moment invariants*.

The first one, $I_1$, is analogous to the moment of inertia around the image's centroid, where the pixels' intensities are analogous to physical density. The last one, $I_7$, is skew invariant, which enables it to distinguish mirror images of otherwise identical images.

A general theory on deriving complete and independent sets of rotation moment invariants was proposed by J. Flusser.[3] He showed that the traditional set of Hu moment invariants is not independent nor complete. $I_3$ is not very useful as it is dependent on the others. In the original Hu's set there is a missing third order independent moment invariant:

$$I_8 = \eta_{11}[(\eta_{30} + \eta_{12})^2 - (\eta_{03} + \eta_{21})^2] - (\eta_{20} - \eta_{02})(\eta_{30} + \eta_{12})(\eta_{03} + \eta_{21})$$

Later, J. Flusser and T. Suk[4] specialized the theory for N-rotationally symmetric shapes case.

Applications

Zhang et al. applied Hu moment invariants to solve the Pathological Brain Detection (PBD) problem.[5]

External links

- Analysis of Binary Images (http://homepages.inf.ed.ac.uk/rbf/CVonline/LOCAL_COPIES/OWENS/LECT2/node3.html), University of Edinburgh
- Statistical Moments (http://homepages.inf.ed.ac.uk/rbf/CVonline/LOCAL_COPIES/SHUTLER3/CVonline_moments.html), University of Edinburgh
- Variant moments (http://jamh-web.appspot.com/computer_vision.html), Machine Perception and Computer Vision page (Matlab and Python source code)
- Hu Moments (https://www.youtube.com/watch?v=O-hCEXi3ymU) introductory video on YouTube

References

1. M. K. Hu, "Visual Pattern Recognition by Moment Invariants", IRE Trans. Info. Theory, vol. IT-8, pp.179–187, 1962.
2. http://docs.opencv.org/modules/imgproc/doc/structural_analysis_and_shape_descriptors.html?highlight=cvmatchshapes#humoments Hu Moments' OpenCV method
3. J. Flusser: "On the Independence of Rotation Moment Invariants (http://library.utia.cas.cz/prace/20000033.pdf)", Pattern Recognition, vol. 33, pp. 1405–1410, 2000.
4. J. Flusser and T. Suk, "Rotation Moment Invariants for Recognition of Symmetric Objects (http://library.utia.cas.cz/separaty/historie/flusser-rotation%20moment%20invariants%20for%20recognition%20of%20symmetric%20objects.pdf)", IEEE Trans. Image Proc., vol. 15, pp. 3784–3790, 2006.
5. Zhang, Y. (2015). "Pathological Brain Detection based on wavelet entropy and Hu moment invariants" (http://content.iospress.com/articles/bio-medical-materials-and-engineering/bme1426). *Bio-Medical Materials and Engineering*. 26: 1283–1290.

Retrieved from "https://en.wikipedia.org/w/index.php?title=Image_moment&oldid=764614779"

Categories: Computer vision

- This page was last edited on 9 February 2017, at 22:44.
- Text is available under the Creative Commons Attribution-ShareAlike License; additional terms may apply. By using this site, you agree to the Terms of Use and Privacy Policy. Wikipedia® is a registered trademark of the Wikimedia Foundation, Inc., a non-profit organization.

What is claimed is:

1. A method for detecting one or more white spot MURA defects in a display panel, the method comprising:

receiving an image of the display panel, the image comprising the one or more white spot MURA defects;

dividing the image into a plurality of patches, each one of the plurality of patches corresponding to an m pixel by n pixel area of the image, m and n being integers greater than or equal to one;

generating a plurality of feature vectors for the plurality of patches, each of the feature vectors corresponding to one of the plurality of patches and comprising one or more image texture features and one or more image moment features; and classifying each one of the plurality of patches based on a respective one of the plurality of feature vectors by utilizing a multi-class support vector machine (SVM) to detect the one or more white spot MURA defects.

2. The method of claim 1, wherein the plurality of patches do not overlap each other.

3. The method of claim 1, wherein each patch is greater in size than an average white spot Mura defect.

4. The method of claim 1, wherein each patch corresponds to a 32 pixel by 32 pixel area of the display panel.

5. The method of claim 1, wherein the one or more image texture features comprise at least one of a contrast grey-level co-occurrence matrix (GLCM) texture feature and a dissimilarity GLCM texture feature.

6. The method of claim 1, wherein the one or more image moment features comprise at least one of a third order centroid moment $\mu_{30}$, a fifth Hu invariant moment $I_5$, and a first Hu invariant moment $I_1$.

7. The method of claim 1, wherein the multi-class SVM is trained using both defect-containing and defect-free images.

8. The method of claim 1, wherein the classifying of the one or more white spot MURA defects comprises:

providing the plurality of feature vectors for the plurality of patches to the multi-class SVM to identify the one or more white spot MURA defects based on the feature vectors; and labeling one or more patches of the plurality of patches comprising the identified one or more white spot MURA defects as defective.

9. A method for training a system for detecting one or more white spot defects in a display panel, the method comprising:

receiving an image of the display panel, the image comprising the one or more white spot defects;

decomposing the image into a first plurality of patches and a second plurality of patches, each of the first and second plurality of patches corresponding to the image of the display panel;

receiving a plurality of labels, each label of the plurality of labels corresponding to one of the first and second plurality of patches and indicating defective or not defective;

generating a plurality of feature vectors, each one of the plurality of feature vectors corresponding to a patch of one of the first and second plurality of patches and comprising one or more image texture features and one or more image moment features; and training a multi-class support vector machine (SVM) to detect the one or more white spot defects by providing the SVM with the plurality of feature vectors and the plurality of labels.

10. The method of claim 9, wherein the second plurality of patches is offset from and overlapping the first plurality of patches.

11. The method of claim 9, wherein each one of the first and second plurality of patches corresponds to an m pixel by n pixel area of the image, m and n being integers greater than or equal to one.

12. The method of claim 9, wherein decomposing the image comprises further decomposing the image into a third plurality of patches and a fourth plurality of patches, each of the third and fourth plurality of patches corresponding to the image of the display panel, wherein the plurality of labels further comprise additional labels corresponding to the third and fourth plurality of patches and indicating defective or not defective, wherein each one of the plurality of feature vectors corresponds to a patch of one of the first, second, third, and fourth plurality of patches, and comprises one or more image texture features and one or more image moment features, wherein each one of the first to fourth plurality of patches corresponds to a 32 pixel by 32 pixel area of the image, and wherein ones of the first to fourth plurality of patches are offset from each other by 16 pixels in at least one of a lengthwise direction and a widthwise direction of the image.

13. The method of claim 9, wherein the one or more image texture features comprise at least one of a contrast grey-level co-occurrence matrix (GLCM) texture feature and a dissimilarity GLCM texture feature.

14. The method of claim 9, wherein the one or more image moment features comprise at least one of a third order centroid moment $\mu_{30}$, a fifth Hu invariant moment $I_5$, and a first Hu invariant moment $I_1$.

15. A system for detecting one or more white spot defects in a display panel, the system comprising:

a processor; and a processor memory local to the processor, wherein the processor memory has stored thereon instructions that, when executed by the processor, cause the processor to perform:

receiving an image of the display panel, the image comprising the one or more white spot defects;

dividing the image into a plurality of patches, each one of the plurality of patches corresponding to an m pixel by n pixel area of the image, m and n being integers greater than or equal to one;

generating a plurality of feature vectors for the plurality of patches, each of the feature vectors corresponding to one of the plurality of patches and comprising one or more image texture features and one or more image moment features; and classifying each one of the plurality of patches based on a respective one of the plurality of feature vectors by utilizing a multi-class support vector machine (SVM) to detect the one or more white spot defects.

16. The system of claim 15, wherein the plurality of patches do not overlap each other, and wherein each patch is greater in size than an average white spot Mura defect.

17. The system of claim 15, wherein the one or more image texture features comprise at least one of a contrast grey-level co-occurrence matrix (GLCM) texture feature and a dissimilarity GLCM texture feature.

18. The system of claim 15, wherein the one or more image moment features comprise at least one of a third order centroid moment $\mu_{30}$, a fifth Hu invariant moment $I_5$, and a first Hu invariant moment $I_1$.

19. The system of claim 15, wherein the multi-class SVM is trained using both defect-containing and defect-free images.

20. The system of claim 15, wherein the each one of the plurality of patches comprises:

providing the plurality of feature vectors for the plurality of patches to the multi-class SVM to identify the one or more white spot defects based on the feature vectors; and labeling one or more patches of the plurality of patches comprising the identified one or more white spot defects as defective.

* * * * *